US005793300A

United States Patent [19]

Suman et al.

[11] Patent Number: 5,793,300

[45] Date of Patent: Aug. 11, 1998

[54] TRAINABLE RF RECEIVER FOR REMOTELY CONTROLLING HOUSEHOLD APPLIANCES

[75] Inventors: Michael J. Suman; Thomas L. Welling, both of Holland, Mich.

[73] Assignee: Prince Corporation, Holland, Mich.

[21] Appl. No.: 461,322

[22] Filed: Jun. 5, 1995

Related U.S. Application Data

[62] Division of Ser. No. 368,232, Jan. 3, 1995, which is a continuation of Ser. No. 32,350, Mar. 15, 1993, abandoned.

[51] Int. Cl.[6] ..... G08B 25/00

[52] U.S. Cl. ..... 340/825.2; 340/825.69

[58] Field of Search ..... 340/825.22, 825.69, 340/825.12

[56] References Cited

U.S. PATENT DOCUMENTS

| | | |
|---|---|---|
| Re. 29,525 | 1/1978 | Willmott . |
| 3,337,992 | 8/1967 | Tolson . |
| 3,543,088 | 11/1970 | Garrett . |
| 3,896,334 | 7/1975 | Rodriguez . |
| 4,162,486 | 7/1979 | Wyler . |
| 4,178,549 | 12/1979 | Lendenbach et al. . |
| 4,197,503 | 4/1980 | Dini . |
| 4,201,944 | 5/1980 | Buenders . |
| 4,360,801 | 11/1982 | Duhame . |
| 4,385,296 | 5/1983 | Tsubaki et al. . |

(List continued on next page.)

FOREIGN PATENT DOCUMENTS 4902920 2/1994 WIPO ..... G08C 17/00

OTHER PUBLICATIONS

Ray Herman et al., "A GPS Receiver with Synthesized Local Oscillator", IEEE, pp. 194–196, Feb. 1989.

Paul Vaccani, "Occupancy Measurement methods in the Radio Frequency Spectrum and Their Use", IEEE, pp. 242–246, Mar. 1987.

Risto Kari, "Fast Training of a High–Speed Voiceband Data Modern Receiver", Doctorial Dissertation, Helsinki University of Technology, pp. 21 and 83–99, Mar. 1991.

Capt. Thomas M. Foltz et al., "A Digital Single Sideband Modulator for a Digital Radio Frequency Memory", IEEE, pp. 926–932, May 1989.

Asad Madni et al., "High–Dynamic–Range Airborne Tracking and Fire Control Radar Subsystems", IEEE, pp. 1942–1948, Jun. 1989.

T. H. Ooi et al., "Low Cost RF Identification and Locating System", IEEE, pp. 831–839, Nov. 1989.

Crutchfield, Winter/Spring, 1992, Home Security Section.

Radio Shack, 1993 Catalog, pp. 84 and 86.

Craftman, Touch Code Transmitter Model B9.J3776, Owners Manual, Copyright 1989.

Sears Plug–In Light Control Module, 139.53774, Owners Manual, Copyright 1992.

*Primary Examiner*—Mark R. Powell

*Attorney, Agent, or Firm*—Price, Heneveld, Cooper, DeWitt & Litton

[57] ABSTRACT

A control system selectively controls the operation of at least one lamp and at least one garage door opener. The control system includes a control module. The control module includes connectors adapted to be coupled to at least one lamp through household AC power conductors. The control module also includes terminals adapted to be connected to a garage door opener mechanism. A circuit positioned in the control module receives and identifies radio frequency signals, stores control information associated with a plurality of received signals from a remote control in a training mode and outputs control signals for communication over the AC power line and the garage door mechanism in accordance with the stored control signals when one of said remote control signals is received in an operating mode. The control module also includes a selector used to select garage door and/or light control operations to be associated with a signal received by the control module in a training mode.

19 Claims, 11 Drawing Sheets

U.S. PATENT DOCUMENTS

| | | | |
|---|---|---|---|
| 4,427,847 | 1/1984 | Hofmann et al. | 348/552 |
| 4,433,274 | 2/1984 | Duhame . | |
| 4,464,651 | 8/1984 | Duhame . | |
| 4,482,947 | 11/1984 | Zato et al. . | |
| 4,509,093 | 4/1985 | Stellberger . | |
| 4,529,980 | 7/1985 | Liotine et al. . | |
| 4,535,333 | 8/1985 | Twardowski . | |
| 4,596,985 | 6/1986 | Bongard et al. . | |
| 4,623,887 | 11/1986 | Welles, II . | |
| 4,626,848 | 12/1986 | Ehlers . | |
| 4,631,708 | 12/1986 | Wood et al. . | |
| 4,635,033 | 1/1987 | Inukai et al. . | |
| 4,652,860 | 3/1987 | Weishaupt et al. . | |
| 4,670,746 | 6/1987 | Taniguchi et al. . | |
| 4,703,306 | 10/1987 | Barritt . | |
| 4,703,359 | 10/1987 | Rumbolt et al. . | |
| 4,750,118 | 6/1988 | Heitschel et al. . | |
| 4,754,255 | 6/1988 | Sanders et al. . | |
| 4,771,283 | 9/1988 | Imoto . | |
| 4,808,995 | 2/1989 | Clark et al. . | |
| 4,825,200 | 4/1989 | Evans et al. . | |
| 4,847,542 | 7/1989 | Clark et al. . | |
| 4,866,434 | 9/1989 | Keenan . | |
| 4,872,205 | 10/1989 | Smith . | |
| 4,878,052 | 10/1989 | Schulze . | |
| 4,881,148 | 11/1989 | Lambropoulos et al. . | |
| 4,890,108 | 12/1989 | Drori et al. . | |
| 4,905,279 | 2/1990 | Nishio | 380/9 |
| 4,912,463 | 3/1990 | Li . | |
| 4,929,877 | 5/1990 | Clark et al. . | |
| 4,953,305 | 9/1990 | Van Lente et al. . | |
| 4,978,944 | 12/1990 | Andros et al. . | |
| 4,988,992 | 1/1991 | Heitschel et al. . | |
| 5,028,919 | 7/1991 | Hidaka . | |
| 5,065,423 | 11/1991 | Gaskill . | |
| 5,072,216 | 12/1991 | Grange . | |
| 5,123,008 | 6/1992 | Beesley . | |
| 5,126,686 | 6/1992 | Tam . | |
| 5,136,548 | 8/1992 | Claar et al. | 367/2 |
| 5,182,551 | 1/1993 | Goto . | |
| 5,189,412 | 2/1993 | Mehta . | |
| 5,227,780 | 7/1993 | Tigwell | 340/825.72 |
| 5,235,327 | 8/1993 | Igarashi et al. . | |
| 5,262,769 | 11/1993 | Holmes . | |
| 5,266,945 | 11/1993 | Peek et al. . | |
| 5,379,453 | 1/1995 | Tigwell . | |
| 5,381,138 | 1/1995 | Stair et al. | 340/825.44 |
| 5,442,340 | 8/1995 | Dykema . | |
| 5,444,499 | 8/1995 | Saitoh | 348/734 |
| 5,475,366 | 12/1995 | Van Lente et al. | 340/525 |
| 5,479,155 | 12/1995 | Zeinstra et al. | 340/824.22 |
| 5,583,485 | 12/1996 | Van Lente et al. . | |

TRAINABLE RF RECEIVER FOR REMOTELY CONTROLLING HOUSEHOLD APPLIANCES

This is a division of application Ser. No. 08/368,232, filed Jan. 3, 1995 which is a continuation of Ser. No. 08/032,350 filed Mar. 15, 1993 and now abandoned.

BACKGROUND OF THE INVENTION

This invention relates to systems for a home which are responsive to a remote control, and more particularly, to a system for remote control of household appliances and a garage door opener mechanism.

Garage door opener mechanisms are well known which selectively open and close a garage door responsive to radio frequency control signals. These mechanisms are sold with an associated remote control which generates and transmits a predetermined radio frequency control signal. The control signal has a preset carrier frequency and control code so that the garage door opener mechanism will only respond to the associated remote control.

The garage door opener mechanism may be connected via conductors to a receiver which controls operation of the garage door opener mechanism. The receiver is associated with a remote control having a predetermined signalling frequency and format. Responsive to radio frequency control signals from the associated remote control, the receiver outputs control signals over the conductors which actuate the garage door opener mechanism.

Systems are also known which control lights or household appliances responsive to a radio frequency control signal. These systems include a receiver module which is plugged into a standard AC power outlet and a remote control associated with the receiver module. These modules also include a module outlet for receipt of a standard male connector of the type used to connect lamps, radios, and other electric appliances to a standard AC power outlets. The receiver module is responsive to a control signal transmitted from the associated remote control to connect the module outlet with the AC power outlet or disconnect the module outlet from the AC power outlet. However, the receiver module is only responsive to an associated remote control having a predetermined carrier-frequency and control code.

These systems for controlling power supplied to appliances may include remote modules coupled to the receiver module through conventional household AC power conductors. In such a system, the remote module is responsive to control signals from the receiver module. The receiver module is in turn responsive to control signals received from an associated remote control having a predetermined carrier frequency and control code. Thus, the control module is responsive to receipt of a particular predetermined radio frequency control signal to transmit a control signal over the AC power conductors to the remote module. The remote module is responsive to the control signals to effect connection or disconnection of the remote module power outlet to the AC power outlet to which the remote module is connected. In this manner, appliances, such as lamps, connected to the remote modules, may be remotely controlled.

It is also known to provide a garage door opener mechanism that transmits a control signal to a remote module over AC power conductors. The remote module is compatible with a transceiver in the garage door opener mechanism and is connected to a wall outlet to receive control signals therethrough. The garage door opener mechanism outputs a control signal to the remote module responsive to a predetermined signal from a remote control associated with the garage door opener mechanism. In this manner, a light remote from the garage door opener may be turned on or off when the garage door is opened or closed.

A problem with these systems is the garage door opener mechanism must receive a specific predetermined control signal to open or close the garage door. Further, each appliance control module requires that a specific predetermined control signal be received to turn the associated appliance on or off. A homeowner wishing to control both the garage door opener and the appliances is required to carry two remote controls in their vehicle. Alternatively, the homeowner may purchase a garage door opener mechanism which also communicates with remote modules. However, this is costly for homeowners who do not need a new garage door opener mechanism.

Accordingly, it is desirable to provide an inexpensive remote control system which controls a garage door opener mechanism and household appliances from a single remote control. It is further desirable that such remote control systems be operable with garage door opener mechanisms and light control systems having different signaling formats. Such system should be inexpensive to retrofit.

SUMMARY OF THE INVENTION

The immediate invention provides a remotely controlled outlet unit which selectively actuates a garage door opener mechanism and household appliances responsive to one or more remote control signals. The system includes a control module which may be used with any garage door opener mechanism. According to one aspect of the invention, the control module communicates through AC power lines with existing remote modules. Accordingly, the system is inexpensive to install and readily retrofitable for use with any garage door opener mechanism.

According to another aspect of the invention, the system includes a control module having a selector with a plurality of different settings. The settings are associated with operating instructions such as lights on, lights off, garage door opener mechanism actuation, or both lights on and garage door opener mechanism operation. When a control signal is stored in the control module in a training mode, the position of the operation selector at the time the control signal is stored determines the operation that the control module will perform responsive to receipt of that control signal.

According to yet another aspect of the invention, a control module includes a sensor for receiving a control signal from a remote control. The control module includes circuitry coupled to the sensor for learning the frequency of the control signal from the remote control and the control signal information in the remote control signal, and for storing this information. The control module may thus learn control signals from any radio frequency remote control.

According to one aspect of the invention,.the control module includes a timer selector. The timer selector allows the homeowner to select the amount of time that lights will be on following receipt of a garage door opener plus lights on control signal. The control module selectively transmits control signals to remote modules which turn the lights off automatically a predetermined time period after the garage door opener mechanism is actuated.

The system according to the invention facilitates retrofitting for use with existing garage door opener mechanisms without requiring new remote controls. Additionally, the system facilitates selective multiple device control responsive to one or more control signals. The system is inexpensive and versatile in implementation.

These and other features, objects and advantages of the present invention will become apparent upon reading the following description thereof together with reference to the accompanying drawings in which:

BRIEF DESCRIPTION OF THE PREFERRED EMBODIMENTS

Figure 1:
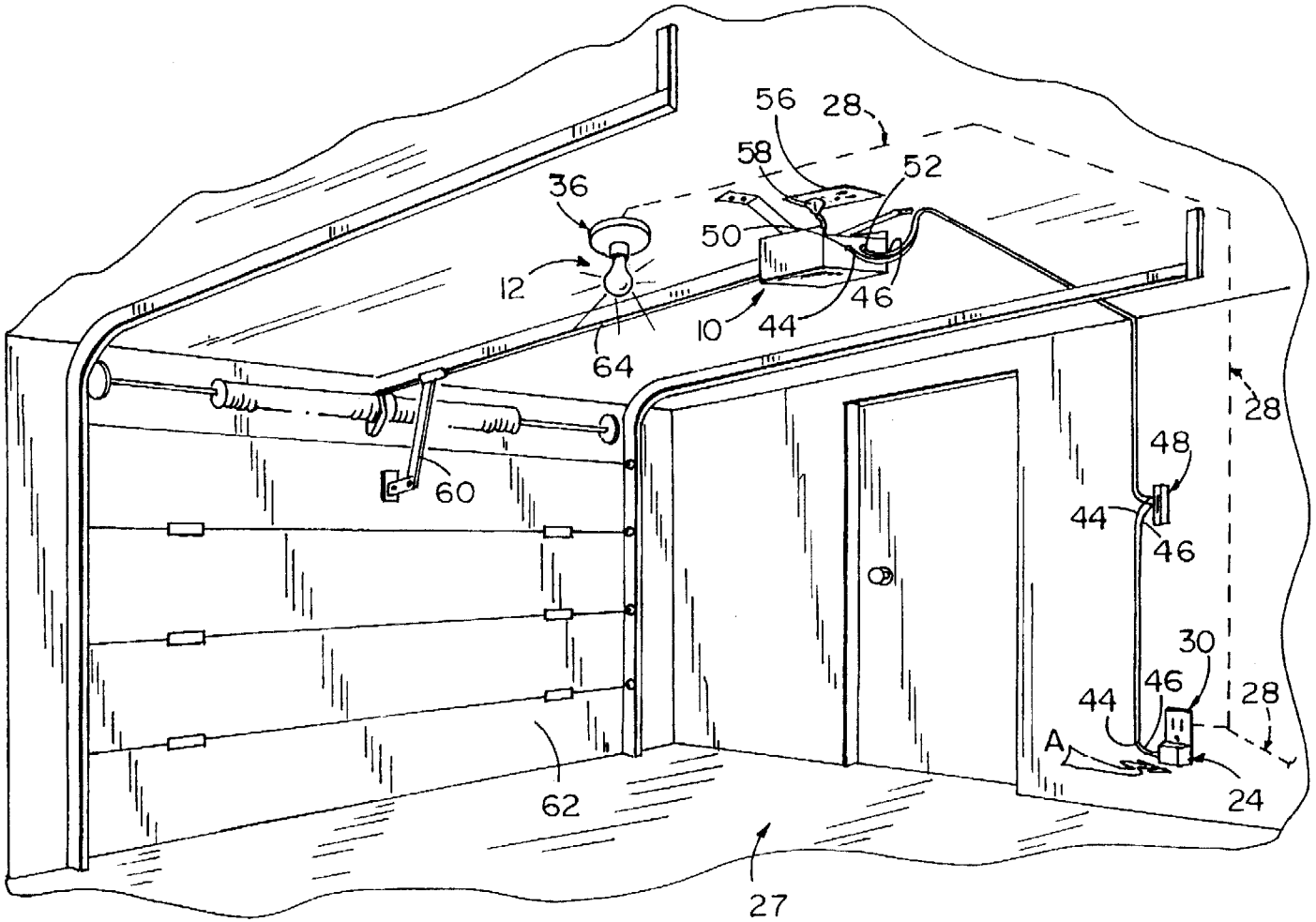
FIG. 1 is a fragmentary perspective view of the interior of a garage including a control system according to the invention.
Figure 2:
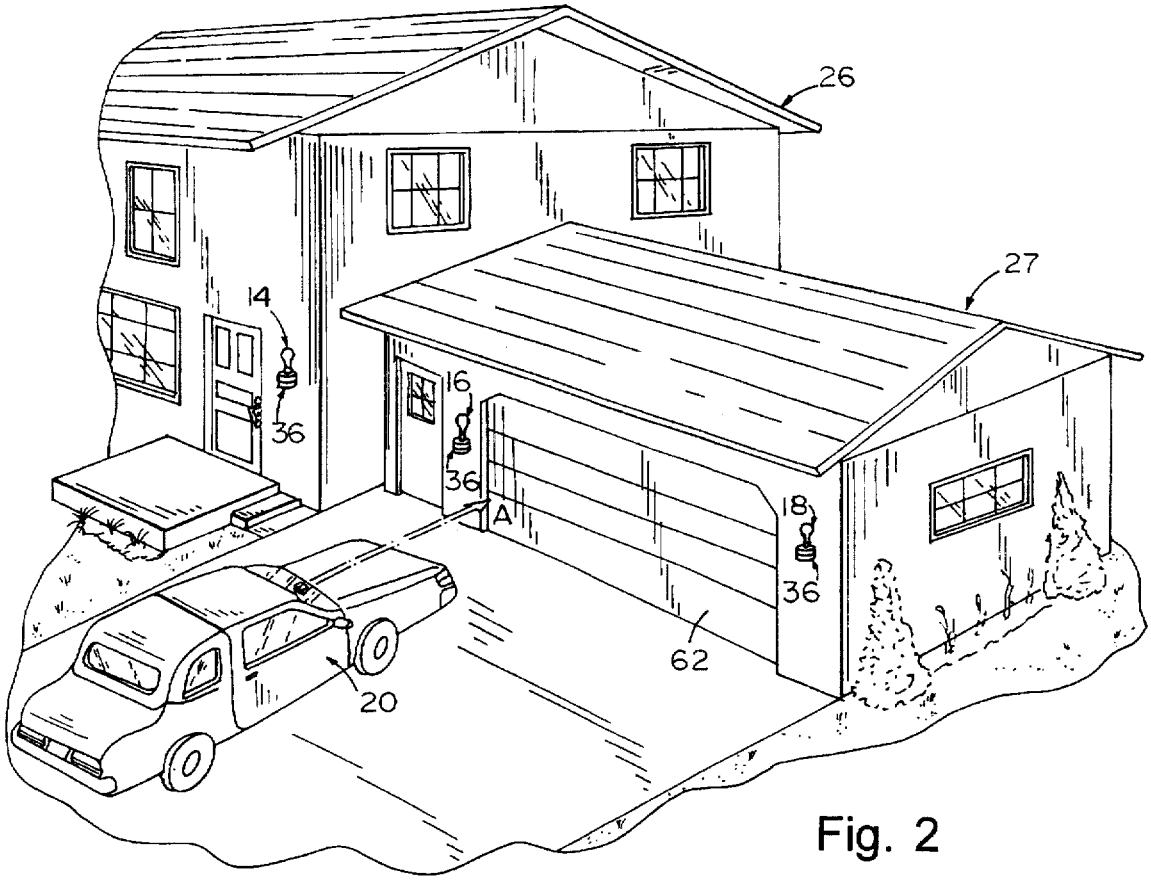
FIG. 2 is a fragmentary perspective view of a vehicle outside of a house and the garage according to FIG. 1.
Figure 5:
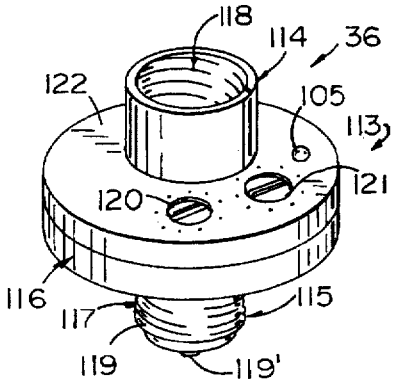
FIG. 5 is a top perspective view of a light socket module for the system illustrated in FIGS. 1 and 2.
Figure 6:
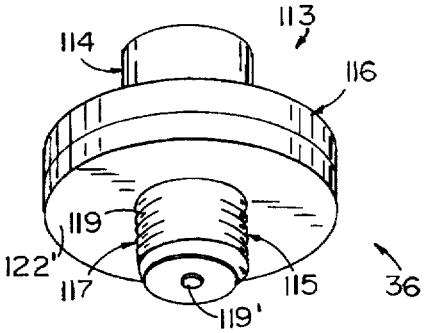
FIG. 6 is another perspective view of the light receptacle socket module according to FIG. 5.

With reference initially to FIGS. 1 and 2, a system according to the invention is illustrated for controlling a garage door opener mechanism 10 (FIG. 1) and lamps 12, 14 (FIG. 2), 16 and 18, from a vehicle 20. The system includes a control module 24 (FIGS. 1, 4 and 10) which receives radio frequency control signals represented by arrow A (FIGS. 1 and 2). The radio frequency control signals are received from a remote control, such as transmitter 22 (FIG. 3), which is mounted to, or otherwise positioned in, vehicle 20. The control module 24 is connected to conventional AC power conductors 28 (FIG. 1) in house 26 (FIG. 2) and garage 27 through a conventional AC wall power outlet 30 (FIG. 1). Lamp fixtures 12, 14, 16 and 18 include respective lamp receptacle modules 36 (FIGS. 5 and 6) which are also connected to AC power conductors 28. Remote lamp receptacle modules 36 receive control signals from control module 24 through AC power conductors 28 as described in greater detail hereinbelow. The control module 24 is also connected to garage door opener mechanism 10 through dedicated conductors 44 and 46 (FIG. 1). As will be described in greater detail hereinbelow, the control module 24 is responsive to receipt of radio frequency control signals A from one or more remote controls, such as transmitter 22, to control garage door opener mechanism 10 and lamps 12, 14, 16 and 18.

The AC power conductors 28 are of a conventional type including electrical conductors and a fuse box (not shown) connected to conventional 110 Volt AC power supply cables (not shown). Power conductors 28 are also connected to light fixtures 12 (FIG. 1), 14 (FIG. 2), 16 and 18. It will be appreciated that the AC power conductors 28 are connected to the other electrical fixtures and wall outlets in house 29, such as outlet 56 (FIG. 1) through which the garage door opener mechanism 10 receives power.

Somewhat more particularly, garage door opener mechanism 10 may be of any conventional, commercially available type. The garage door opener mechanism includes a motor (not shown). The motor is connected to conventional AC wall outlet 56 through a conventional male connector 58. The motor is also connected via a linking element, such as a screw drive or a chain (not shown), to a lever 60. Lever 60 is hingedly connected to garage door 62. The linking element is supported on beam 64.

The garage door opener mechanism 10 includes terminals 50 and 52 connected to the motor. Terminals 50 and 52 are connected to conductors 44 and 46 to receive control signals for the garage door opener mechanism. The garage door opener mechanism is responsive to control signals input across terminals 50 and 52 to actuate the motor in a conventional manner. When the motor is actuated, lever 60 is propelled by the linking element and motor to move garage door 62 between an open position and a closed position (the closed position shown in FIGS. 1 and 2).

Conductors 44 and 46 are connected to terminals 40 (FIG. 4) and 42 of control module 24. Control module 24 includes an internal switch 184 (FIG. 10), connected to terminals 40 and 42, which is selectively closed to energize the garage door mechanism as described in greater detail herein below.

Conductors 44 and 46 may optionally be connected to a manually actuated wall switch 48. The control module and optional switch are thus connected in parallel to terminals 50 and 52 of the garage door opener mechanism when switch 48 is provided in the system. Switch 48 may be implemented by any suitable conventional wall switch for use with garage door opener mechanisms. Switch 48 includes a contact (not shown) connected to conductor 44 and a contact (not shown) connected to conductor 46. The switch is closed to connect conductors 44 and 46, and thus terminals 50 and 52, to actuate the garage door mechanism in a conventional manner. A homeowner may thus actuate the garage door opener mechanism using switch 48 or control module 24.

Figure 4:
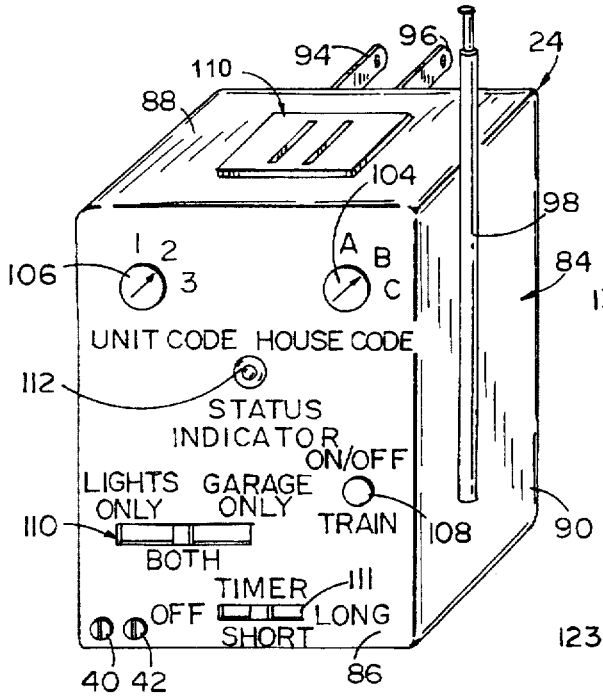
FIG. 4 is a front perspective view of a control module for the control system illustrated in FIG. 1.

Control module 24 includes a generally rectangular housing 84 (FIG. 4). Housing 84 has a front face 86, a top wall 88, a side wall 90 and opposite back, side and bottom walls (not shown). Housing 84 may be of any suitable conventional construction such as integrally molded of an organic polymer. Male connectors 94 and 96 project outwardly from the back wall of housing 84 for connection with AC power conductors 28 through conventional AC power outlet 30. The male connectors are of a conventional type which connect with female contacts in a standard AC power outlet of the type used for electric appliances such as lamps, radios, televisions, etc. . . .

An antenna 98 is mounted on side wall 90 and connected to circuitry within housing 84. Antenna 98 provides a sensor for radio frequency signals. A conventional female power outlet 110 is provided on housing 84. Outlet 110 may be a three contact power outlet or a two contact power outlet. At least one contact of outlet 110 is selectively connected to connector 94 through control module 24 as described in greater detail hereinbelow.

The front face 86 of control module 24 includes terminals 40 and 42 as described briefly above. Terminals 40 and 42 may be provided by any suitable metal threaded fasteners which are received in conventional threaded apertures positioned on housing 84. Face 86 also includes an optional house code selector 104. The house code selector is utilized to select one of three codes to be associated with that unit. The house code selector may be used where two houses in close proximity both include control systems according to the invention. Each house is given a different house code using selector 104. The control system of one house will accordingly not respond to the control signals for control system of the other house. The control module also includes a unit code selector 106. The unit code selector is utilized to choose the units within a house which will be associated. If a house has more than one control module, remote modules may be programmed to respond to different control modules using the unit code selector. Those remote modules coupled to control module 24 and having the same unit and house code will respond to signals output by control module 24 through connectors 94 and 96 and household power conductors 28.

An on/off train switch 108 projects through face 86 of control module 24 and is utilized for training the control module as described in greater detail hereinbelow. Switch 108 may be provided by any suitable, conventional push-button switch. A status indicator 112 is provided on control module 24. Indicator 112 provides a visual indication of training when switch 108 is closed (e.g., indicator 112 may flash when a training mode is entered). The indicator may be provided by any suitable, conventional lamp such as a light emitting diode (LED). A three position operation selector 110 is accessible through face 86 for selecting one of light control operation, garage door opener mechanism control operation, or both operations, in a training mode, as described in greater detail hereinbelow. A three position timer selector 111 is accessible through face 86 to select a time period that a light which is turned on using control module 24 will remain on. The time period that the light remains on may be a short time period (e.g., 15 minutes) or a long time (e.g. 30 minutes). Selector 111 may also be used to turn the timer off, such that a light turned on responsive to the garage door opener operation will remain on until the user turns them off.

Lamp receptacle modules 36 (FIGS. 5 and 6) are a first type of remote module in the system. Each receptacle module 36 includes a housing 113. Housing 113 includes cylindrical, outwardly extending silos 114 and 115 projecting orthogonally from a top wall 122 and a bottom wall 122', respectively, of a central disk 116. Housing 113 is of any suitable conventional construction such as a molded organic polymer. A male connector 117 is provided on silo 115. Silo 114 includes a conventional female lamp receptacle 118 for receipt of, and connection to, a conventional light bulb (not shown). Male connector 117 is of a conventional type for receipt in, and connection to, a conventional female lamp receptacle (not shown). Male connector 117 includes an external threaded contact 119 and an internal contact 119'. Housing 113 also includes a unit code selector 120 and a house code selector 121 on a top wall 122 of central disk 116. A manual on/off switch is also positioned on top wall 122.

The lamp receptacle module 36 includes internal switches (not shown) which selectively connect the female lamp receptacle 118 to the male connectors 117 and 119. The internal circuit components may be provided by any suitable, conventional circuitry which receives control signals over the AC power lines, such as the circuit in "X-10" modules available from Radio Shack and Crutchfield. The module is responsive to signals from control module 24 to open and close the internal switches. The unit code and house code are used to associate module 36 with control module 24 in a conventional manner.

Figure 7:
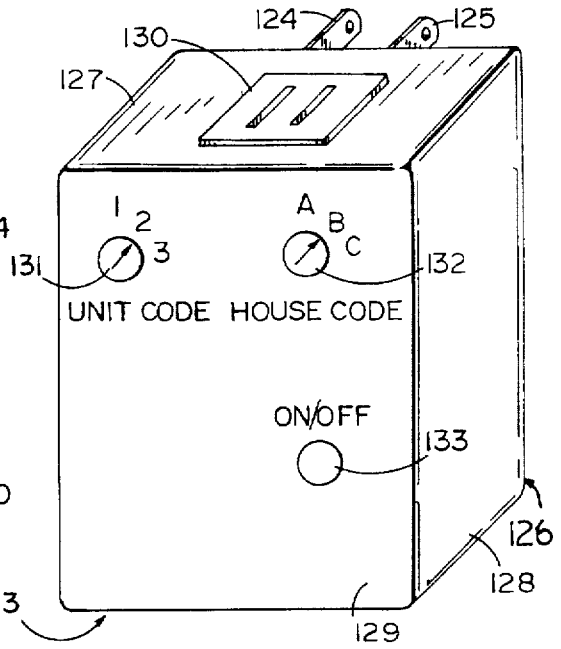
FIG. 7 is a front perspective view of an outlet module for the control system according to FIG. 1.

An outlet module 123 (FIG. 7) is a second type of remote module in the control system. Outlet module 123 includes connectors 124 and 125 for connection with female contacts in a conventional AC power outlet. The wall outlet includes a generally rectangular housing 126 including a top wall 127, a side wall 128 and a front face 129. Top wall 127 includes a female power outlet 130 for receipt of a conventional male connector of the type utilized with radios, clocks, lamps, etc. . . . The module includes circuitry of a conventional design which selectively connects contacts in outlet 130 to connecters 124 and 125 responsive to signals transmitted over the AC power conductors 28. For example, the circuit in commercially available "X-10" modules sold by Radio Shack or Crutchfield may be utilized.

The front face 129 of module 123 includes a unit code selector 131 and a house code selector 132. These selectors are used to associate remote module 123 with control module 24 in a conventional manner. Contacts within outlet 130 are selectively connected to contacts 124 and 125 responsive to the control signal from control module 24 in a conventional manner. An on/off switch 133 is provided on the front face of the remote module 123 to connect contacts in outlet 130 with connectors 124 and 125 without a remote control. A homeowner may thus actuate switch 133 to turn an appliance connected to module 126 on and off manually.

Figure 9:
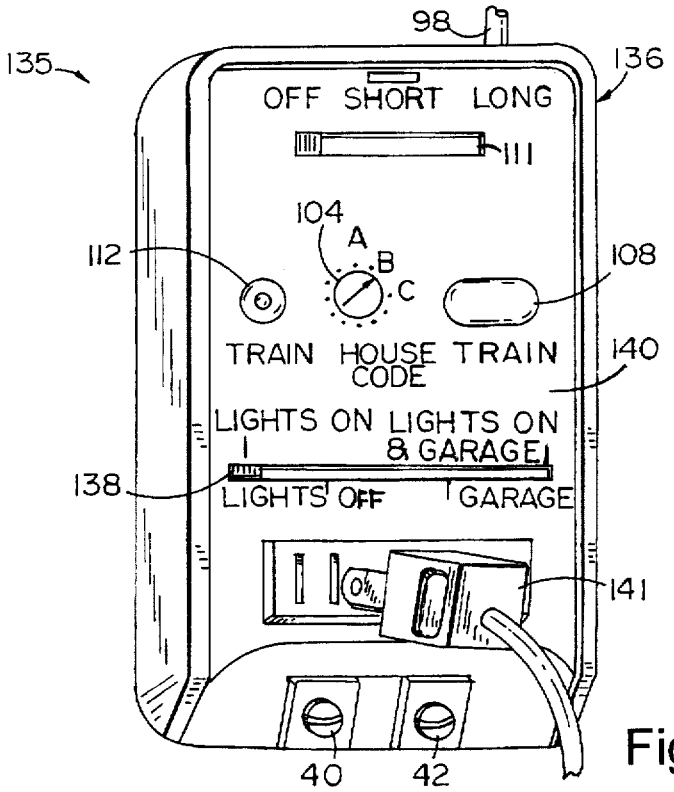
FIG. 9 is a front perspective view of the alternate embodiment according to FIG. 8 with the cover removed.
Figure 8:
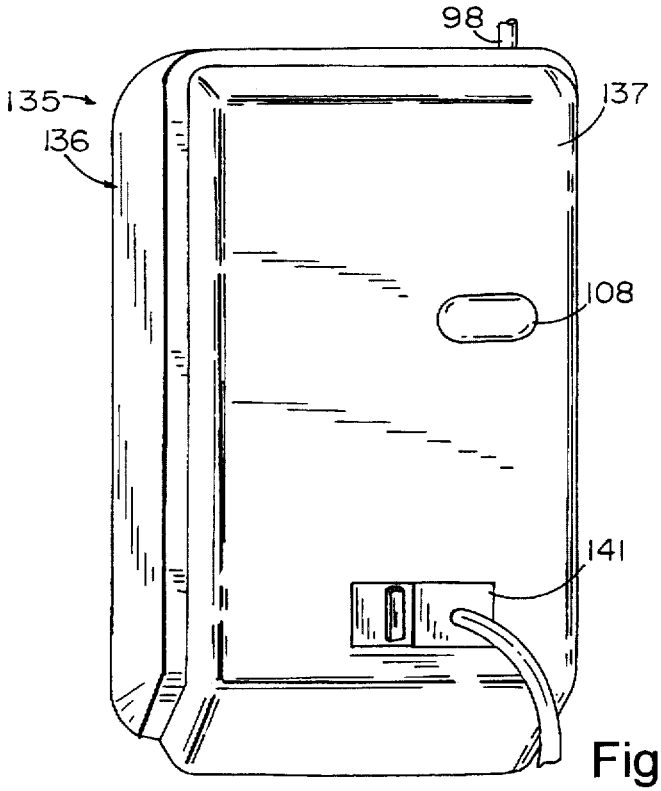
FIG. 8 is a front perspective view of a control module according to an alternate embodiment of the invention and including a cover.

Control module 135 according to an alternate embodiment of the invention is illustrated in FIGS. 8 and 9. Control module 135 includes a base 136 and a cover 137. Base 136 houses an on/off train button 108, a timer selector 111, a visual indicator 112, a home code selector 104, a four position operation selector 138, a female outlet 110 (not shown), an antenna 98, and terminals 40 and 42. Operation selector 138 is a four position switch. The additional position of selector 138 enables the user to turn the lights off using the remote control. Removable cover 137 is positioned over a face 140 of control module 135. Cover 137 protects face 140 and circuit components in transceiver 136 from moisture and dirt. Outlet 110 and on/off train button 108 are accessible through cover 137 when it is attached to transceiver base 136. Cover 137 is preferably hingedly attached to the transceiver base 136. Alternatively, snap connectors (not shown) may be used to connect cover 137 to the transceiver base. The outlet 110 is not shown in FIGS. 8 and 9 since a conventional male connector 141 is illustrated connected thereto. Connector 141 is of the type conventionally used with lamps, radios, and other electric appliances.

The circuit within control modules 24 and 135 will now be described with reference to FIG. 10. Control module 24 includes a control circuit 142. A microcontroller 143 in control circuit 142 includes a radio frequency receiver and a power line transmitter for transmitting control signals over the AC power conductors. The circuit components for transmitting signals over the AC power conductors may be provided by any suitable, conventional transmission circuit, such as that commercially available in an "X-10" transmitter sold by Radio Shack and Crutchfield. The radio frequency receiver is preferably a trainable receiver provided by the circuitry shown in FIGS. 11 and 12. The trainable receiver is used to learn the signal from any radio frequency remote control such that a vehicle owner need not purchase a separate remote control to communicate with control module 24. Preferably, the power line transmitter and the radio frequency receiver are implemented using a suitable, commercially available microprocessor.

Control module 24 (FIG. 4) and control module 135 include selectors 111 and 138 respectively. The three position selector and the four position selector are substantially identical, aside from the number of positions provided by each selector. Accordingly, only the four position selector is described in greater detail hereinbelow. Selector 138 is provided by any suitable sliding switch. As illustrated in FIG. 10, the four position selector 138 connects one of conductors 144–147 to ground. When the ground conductor of selector 138 is connected to conductor 144, the microcontroller associates a lights on operation and garage door operation with a received signal in a training mode. If the ground conductor of selector 138 is connected to conductor 145, the microcontroller associates lights off control and garage door operation with a signal received in a training mode. If the ground conductor of selector 138 is connected to conductor 146, the microcontroller associates only garage door opener mechanism operation with the received signal. If the ground conductor of selector 138 is connected to conductor 147, the microcontroller associates a control signal received in a training mode with lights on and garage door opener actuation mechanism.

Selector 111 is provided by any suitable sliding switch. As illustrated in FIG. 10, selector 111 connects one of conductors 191, 193 and 195 to ground. When the ground conductor of selector 111 is connected to conductor 193, the microcontroller does not limit the time period that lights turned on with garage door opener mechanism actuation will remain on. If the ground conductor is connected to conductor 191, the microcontroller will limit the time period that lights will remain on following garage door opener mechanism actuation to a first, short time period. After the predetermined time period ends, the microcontroller 143 will transmit a control signal over the AC power conductors to remote modules which turns the lights associated therewith off. If the ground conductor of selector 111 is connected to conductor 195, the microcontroller limits the time period that lights will remain on to a second, longer timer period. At the end of the predetermined time period, the microcontroller transmits a control signal over the AC power conductors to remote modules which turn the lights associated therewith off.

It will be appreciated that the lights may also be turned off responsive to a light off control signal. The timer selector, however, provides a means to automatically turn the lights off without the homeowner taking any further action. Once inside the house, and before the timer times out, the homeowner can turn lights on manually. Because the timer can be defeated, or set to more than one time period, the timer provides a great deal of flexibility. Additionally, because the timer is implemented using a three position switch, the timer provides a low cost method of shutting off lights which are turned on by the control module when the garage door opener is actuated.

Switch 108 (FIGS. 4, 9, and 10) includes a contact 150 (FIG. 10) connected to ground and a contact 152 connected to microcontroller 143 via conductor 154. When the switch is closed, conductor 154 is connected to ground. This state is sensed by microcontroller 143 to initiate a training mode or to change the state of outlet 110.

Radio frequency signals are sensed and input to microcontroller 143 through antenna 98. Signals from antenna 98 are connected to an amplifier 158 through a conductor 160. The output from amplifier 158 is input to microcontroller 143 through conductor 162. Amplifier 158 amplifies and filters signals sensed by antenna 98.

Power is input to microcontroller 143 through connectors 94 and 96. Connector 96 is the ground connection for the control module. Connector 94 is connected through conductor 166 to power supply 168. Power supply 168 provides a regulated output potential to microcontroller 143 through conductor 170. Conductor 166 is also connected through a switch 172 to a contact 173 of outlet 110. The other contact 175 of outlet 110 is connected to circuit ground. Switch 172 is controlled to close, and thereby connect a contact 173 of outlet 110 to the power supply wiring 28 through the control module, when a "lights on" control signal is received by the control module, or responsive to actuation of switch 108. Switch 172 is opened responsive to receipt of a "lights off" signal, or actuation of switch 108.

The control module outputs signals through connectors 94 and 96 and terminals 40 and 42. Microcontroller 143 preferably includes circuitry which transmits control signals over the AC power line. These signals are output from microcontroller 143 on conductor 180. An amplifier 182 is connected to microcontroller 143 to buffer the output of the microcontroller and control the gain of the output signals. The output signals from amplifier 182 are connected to conductor 166 for communication over the AC power conductors 28.

Microcontroller 143 is also coupled to a switch 184. A first contact 186 associated with switch 184 is connected to terminal 40. A second contact 188 associated with switch 184 is connected to terminal 42. Switch 184 is provided by any suitable conventional switch, such as a relay switch having an associated relay coil connected to microcontroller 143. Alternatively, switch 184 may be provided by electronic circuit components such as a MOSFET element or an "electronic relay." Switch 184 connects contacts 186 and 188 to actuate the garage door mechanism.

Figure 3:
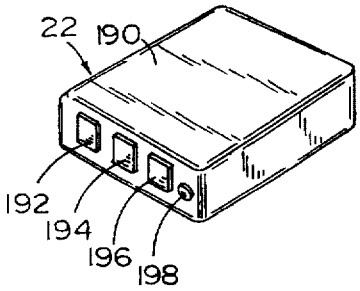
FIG. 3 is a perspective view of a transmitter module which may be mounted in the vehicle in FIG. 2.

The control module 24 is responsive to signals from a remote control, such as transmitter 22 (FIG. 3). The transmitter may be positioned in vehicle 20 or held by a homeowner. The illustrated transmitter 22 emits a plurality of radio frequency control signals, which may, for example, be in the frequency range of 200–400 Mhz. The signals transmitted by transmitter 22 are received and processed by control module 24, 135 (FIGS. 1, 4, 8, 9 and 10).

Transmitter 22 (FIG. 3) according to the illustrated embodiment includes a generally rectangular housing 190 for connection in a vehicle accessory. Transmitter 22 is preferably mounted in the vehicle, and may be positioned within a vehicle map lamp, an overhead console, a visor, or other vehicle accessory. The trainable transmitter 22 includes three control buttons 192, 194, 196 and a LED indicator 198. Each control button 192, 194 and 196 is associated with a respective control signal. The transmitter also includes an indicator 198. The trainable transmitter is preferably provided by the housing and connectors disclosed in U.S. Pat. No. 4,241,870, entitled REMOTE TRANSMITTER AND HOUSING issued to Marcus on Dec. 30, 1980, the disclosure of which is incorporated herein by reference thereto. The trainable transmitter 22 also preferably includes circuitry shown in FIGS. 11 and 12.

Figure 11:
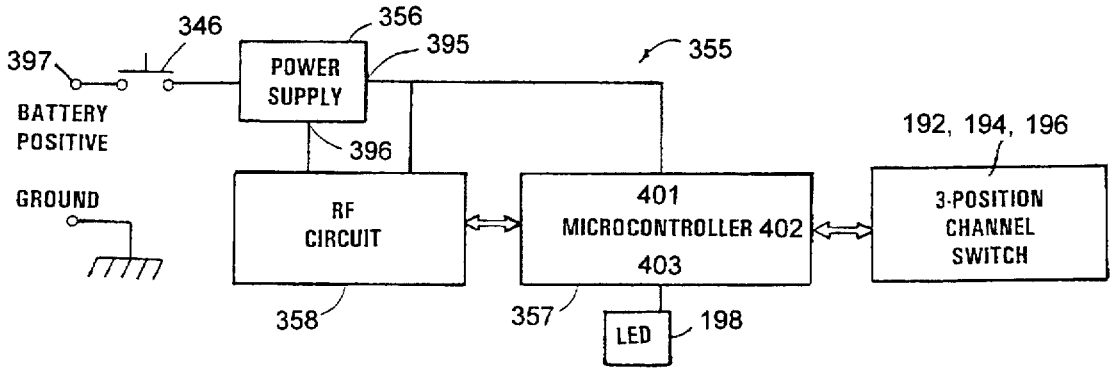
FIG. 11 is an electrical circuit diagram partly in block and schematic form of a transceiver embodying the present invention.
Figure 12:
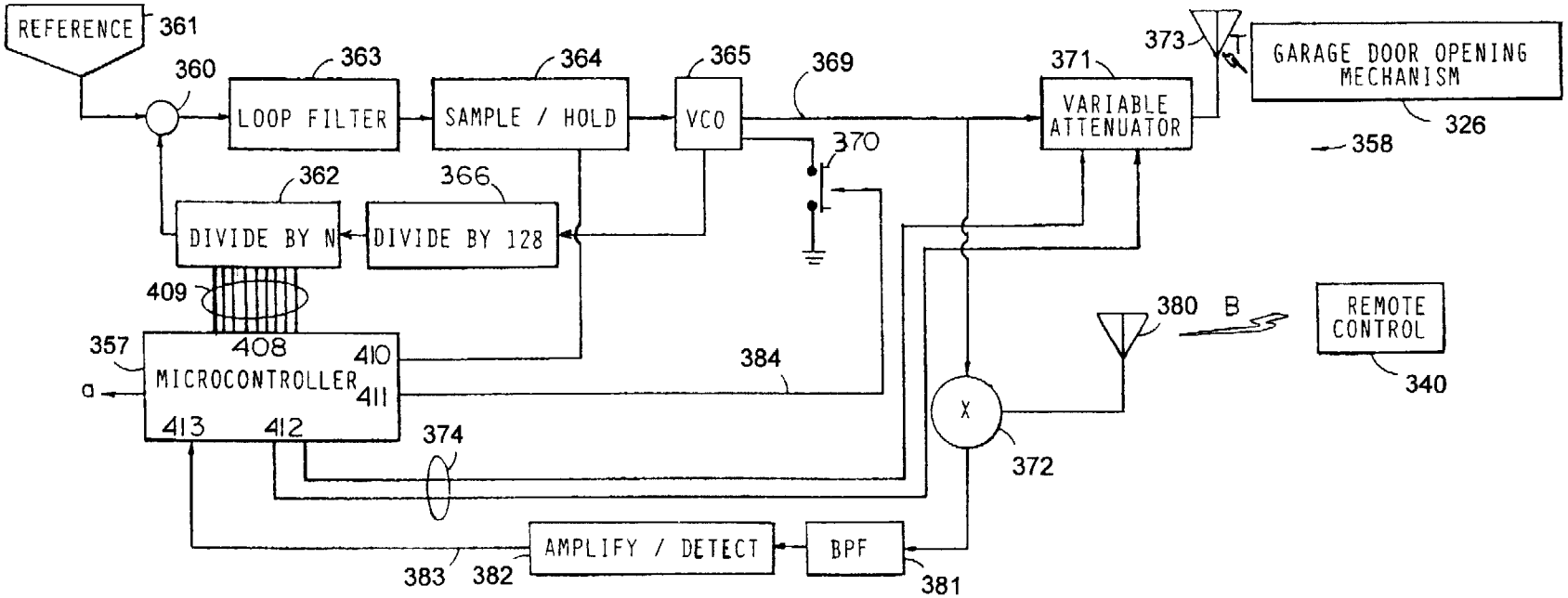
FIG. 12 is an electrical circuit diagram partly in block and schematic form of a transceiver embodying the present invention.

Referring to FIG. 11, RF transceiver circuit 355 is mounted within a mirror housing or module housing 190 (FIG. 3) and includes a power supply 356 for converting operating power from the vehicles battery supply to the necessary voltage levels for activation of the electrical circuits to which supply 356 is coupled in a conventional manner. Circuit 355 includes a micro-controller 357 coupled to an RE circuit 358 and to channel select switches 192, 194, and 196. Circuit 355 also includes an indicator LED 198, and a transmit switch 346 coupling power supply 356 to the vehicle's battery positive supply, and a connection to battery ground. As seen in FIG. 12, RF circuit 358 includes a summing circuit 360 which sums a signal output from reference signal generator 361 and a signal output from a divide-by-N divider 362. Reference generator 361 generates a fixed frequency signal and may include a commercially available crystal oscillator with an output frequency of approximately 8 MHz and a divider which reduces the reference frequency signal to 7.8125 kHz. The controllable divider 361 is provided by any suitable commercially available divider, such as integrated circuit model numbers 145151 or 145106. The output signal from summing circuit is coupled to the input of a loop filter 363, which is preferably an active integrator including an operational amplifier and a capacitor. The output of the integrator is a DC signal which is applied to the input of a sample-and-hold circuit 364. Sample-and-hold circuit 364 is of any suitable construction such as a switch and capacitor (not shown) with the switch being controlled by a control signal from the output 410 of micro-controller 357. The output of sample-and-hold circuit 364 is applied as a control input signal to a voltage controlled oscillator (VCO) 365.

The output frequency of VCO 365 will increase or decrease according to the magnitude of the control input voltage from sample-and-hold circuit 364. The voltage controlled oscillator may be any suitable voltage controlled oscillator which is tunable to frequencies between 200 and 400 MHz with an input tuning control voltage of 0 to 7 volts, and adapted to operate in the automobile environment. In a preferred embodiment of the invention, VCO 365 is of the type including two varactor diodes, two transistors, capacitors, resistors and an inductor coupled to provide the desired frequency output for a given input voltage. RF circuit 358 also includes a switch 370 connected in parallel with the inductor in VCO 365 such that the VCO generates an oscillating output signal when switch 370 is open. When switch 370 is closed, the inductor is shorted, and the VCO outputs a DC signal. Switch 370 may be any suitable switch, such as a bipolar transistor, an FET, a relay switch, or the like. Sample-and-hold circuit 364 holds the control input voltage to VCO 365 at a set level when the VCO stops generating an oscillating output signal such that the VCO will output a signal having the desired frequency when the VCO is switched from off to on.

The output of VCO 365 is inputted to a divide-by-128 divider 366, a variable attenuator 371, and a mixer 372. Variable attenuator 371 conventionally includes series circuits each of which has a resistor and a switch connected between a node of divider network and ground for controlling the magnitude of the output signal of VCO 365 such that the signal output from VCO 365 has an amplitude inversely related to the duty cycle of control pulses applied to switch 370. Accordingly, signals having a longer on time have a smaller amplitude than signals having a short on time to comply with Federal Communication Regulations. Each of the resistors of attenuator selectively shunts the output of VCO 365 under the control of its associated solid state switch. The switches are controlled by attenuator select signals at output 412 of micro-controller 357. In one implementation of the invention, variable attenuator 371 includes two impedance devices connected in parallel between antenna 373 and ground. Each impedance device includes a resistor connected in series with a switch which may be any suitable device such as bipolar transistors, an FET switch, or the like. In operation, one, two, or neither of the resistors is connected to shunt the output of VCO 365 depending upon duty cycle of the control signal input to switch 370.

Mixer 372 combines the signal output from VCO 65 with signal "B" from remote control 340, which is received by antenna 380. The output signal from mixer 372 is applied to filter 81 and will have a frequency of 3 MHz when the output of VCO 365 is 3 MHz greater than the frequency of the signal from remote control 340. A conventional bandpass filter 381 has a center frequency of 3 MHz to pass the detected signal output of mixer 372 which is applied to the input of amplifier/detector 382. Amplifier/detector 382 includes a half-wave rectifier, provided by a series diode (not shown), and an amplifier. The output of amplifier detector 382 is a digital signal applied to input 114 of micro-controller 357.

Micro-controller 357 controls the operation of circuit 355, and may be provided by any suitable commercially available integrated circuit, such as IC model number HC05P1 available from Motorola. The micro-controller preferably includes a non-volatile memory in which the micro-controller program is stored. The power supply 356 (FIG. 11) provides a regulated 5 volt DC reference potential at terminal 395 and a regulated 12 volt DC reference potential at terminal 396. Circuits for providing the regulated voltages are well known and accordingly will not be described in further detail herein. Power supply 356 receives power from the vehicle battery through switch 346 and battery positive conductor 397. Switch 346 is closed whenever one of switches 192, 194, or 196 is pushed. Accordingly, when switch 346 is closed, power is supplied to RF circuit 358 and microprocessor 357. The micro-controller 357 includes a power supply input 401 connected to the 5 volt power supply output 395 to receive power therefrom. Terminals 402 of microcontroller 357 are connected to channel switches 192, 194, and 196 to provide the microcontroller with an indication of the channel switch 192, 194, and 196 that was depressed. Output terminal 403 is connected to LED 198 to energize the LED as described in greater detail hereinafter.

The RF circuit 358 connected to micro-controller 357 includes all of the circuit elements shown in FIG. 12 except for micro-controller 357, garage door opener mechanism 326, and the existing remote control 340. Outputs 408 of micro-controller 357 are connected to divide-by-N divider 362 through multi-conductor bus 404. Bus 404 is connected to the control input of divide-by-N counter 362 to select the frequency of the signal output by divide-by-N counter 362. Output 410 of micro-controller 357 is connected to control the sample-and-hold circuit 364 to hold a signal level when switch 370 is closed such that VCO 365 does not output oscillating signals. Output 411 of micro-controller 357 is connected to the control input of switch 370. Outputs 412 of micro-controller 357 are connected to variable attenuator 371 to select the degree of attenuation to be provided to the signal output from VCO 365. Signals received by antenna 380 are connected to data input 413 of micro-controller 357 through amplifier/detect circuit 382, bandpass filter 381, and mixer 372. The circuit represented by FIGS. 11 and 12 is a self contained trainable transmitter for the environment illustrated in FIG. 3.

Figure 13A:
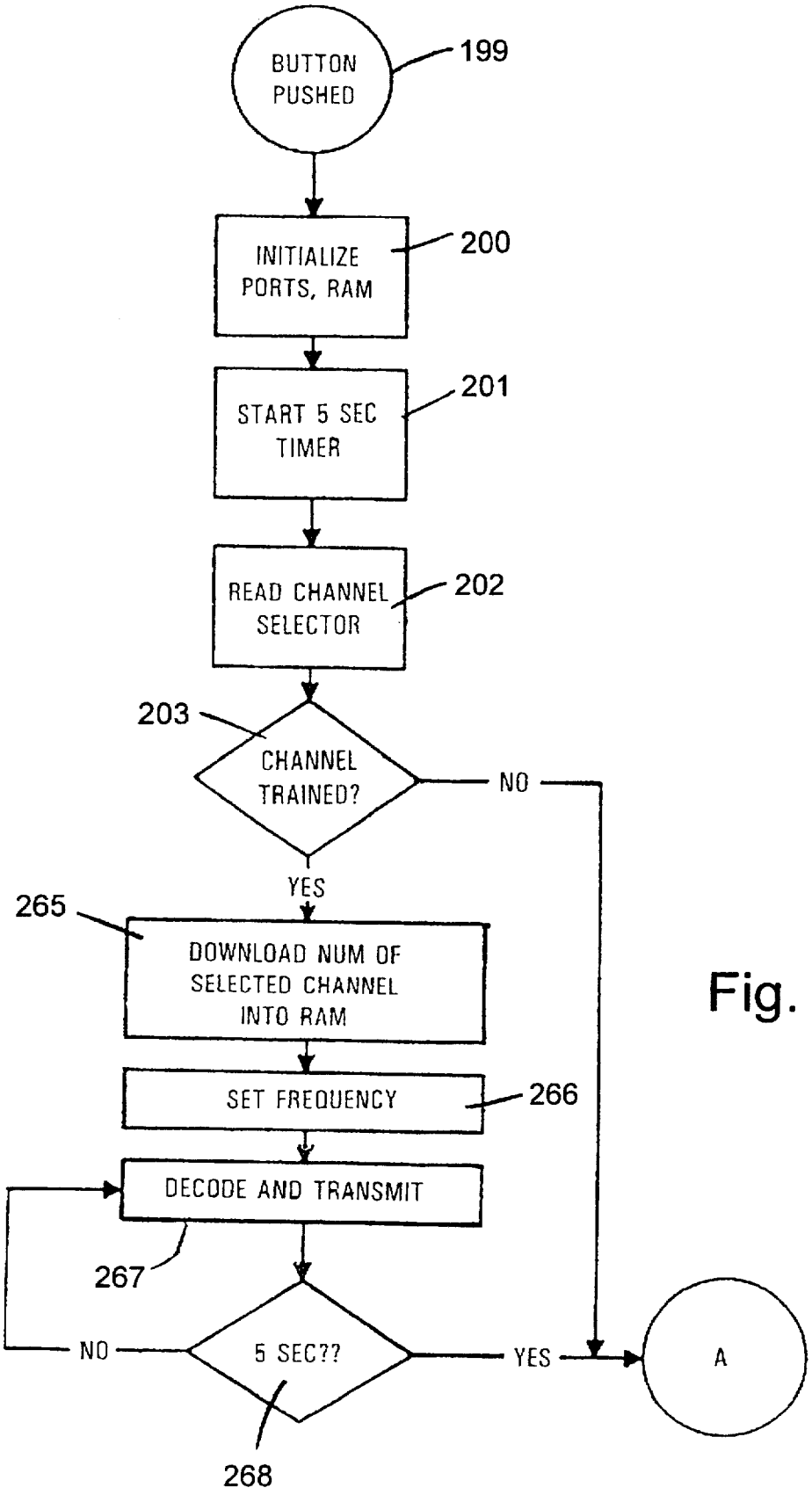
FIG. 13*a*, 13*b*, and 13*c* constitute a flow diagram of the main program employed in the micro-controller of the programmable control circuit shown in FIGS. 11 and 12.

The program begins when any one of switches 192, 194, or 196 (FIG. 3) of the trainable transmitter is pushed causing switch 346 to close such that the battery positive conductor 397 (FIG. 11) is connected to power supply 356 as indicated by block 199 in FIG. 13*a*. Power supply 356 generates a 12 volt DC supply potential provided to RF circuit 358 and a 5 volt DC power supply provided to micro-controller 357 and RF circuit 358. The 5 volt DC supply potential provided to micro-controller 357 powers up the micro-controller. Upon power up, the micro-controller initializes its ports and clears its internal random access memory (RAM) in a conventional manner, as indicated by block 200. After the microcontroller initializes the ports and the RAM, a 15 second timer is started as indicated in block 201. The actual amount of the time in this timer may be as short as 5 seconds or as long as 20 seconds. The micro-controller program then reads inputs 402 to determine which one of the channel selector switches 192, 194, or 196 is depressed (FIG. 3) to determine whether channel 1, 2 or 3 is selected by the user, as indicated in block 202. The micro-controller program determines whether the channel selected by the user is already trained, as indicated in decision block 203. If the selected channel is not trained, the micro-controller program initializes a pointer associated with a frequency table, as indicated in block 204 of FIG. 13*b*.

The frequency table includes frequency control words for all the frequencies at which data is expected. Remote control transmitters which are utilized to control garage door openers have certain frequencies at which they operate. The table contains frequency control signals which control divide-by-N counter 362 to output a signal which controls the RF circuit to selectively generate output signals at these known frequencies. The table is dynamic, such that additional memory locations are provided in the non-volatile memory which may be accessed to store a new frequency control signal without remasking the non-volatile memory. For example, the micro-controller non-volatile memory can be an electronically erasable programmable read only memory (EEPROM) and the transceiver housing can include a port (not shown) through which the EEPROM is externally accessed for programming the non-volatile memory to include a new frequency. Alternately, a functional tester (not shown) utilized in the manufacturing process, which examines the non-volatile memory, may be used to store additional frequency control signals in the non-volatile memory. Accordingly, frequency control words may be added to accommodate different frequencies which garage door opener mechanism manufacturers add at a later time.

The frequency control word identified by the table pointer controls RF circuit 355 to generate an output signal at a frequency F to detect a possible frequency $F_0$ of signal B from remote control 340. The frequency $F_0$ is detected when VCO 365 outputs a signal F which is 3 MHz below $F_0$. The micro-controller program initially selects a frequency control word which controls the VCO 365 to output a signal which is 4 MHz less than frequency $F_0$, as indicated in block 205. The micro-controller program clears an X register, which is an eight bit register internal to the micro-controller, as indicated in block 206. The X register is utilized as a counter. The micro-controller program next calls a "VERIFY" subroutine as indicated in block 207, which determines whether data is being received by the micro-controller and is described below in greater detail in connection with FIG. 14. If data is being received, an internal data acknowledge flag (DACK) is set, and the micro-controller program determines whether the data is being received by examining the DACK flag, as indicated in decision block 208. If data is not being received, the X register is incremented, as indicated in block 209. If the count in register X is less than 4, as determined by the micro-controller in decision block 210, the frequency output by VCO 65 is increased by 1 MHz. The program then repeats steps 207–211 until data is received, as indicated by the DACK flag, or the count in register X reaches 4. If the count in register X reaches 4 before data is received, the micro-controller program determines whether data was previously detected by checking a DATPREV flag, as indicated in block 212.

If it is determined that data is received, such that the DACK flag is set, the micro-controller program determines whether the frequency $F_0$ selected by the frequency control word is the best frequency for emulating the signal from remote control 340. Data should be detected at input 413 of micro-controller 357 when frequency F output by VCO 365 is 3 MHz less than the frequency $F_0$ from remote control 340. The roll-off characteristic of filter 380 is such that data will sometimes be detected when the frequency output by VCO 365 is within the range which is 4 MHz to 2 MHz below the signal from remote control 340. Accordingly, the micro-controller program must be able to distinguish between frequencies one MHz apart.

Figures 13B, 13C:
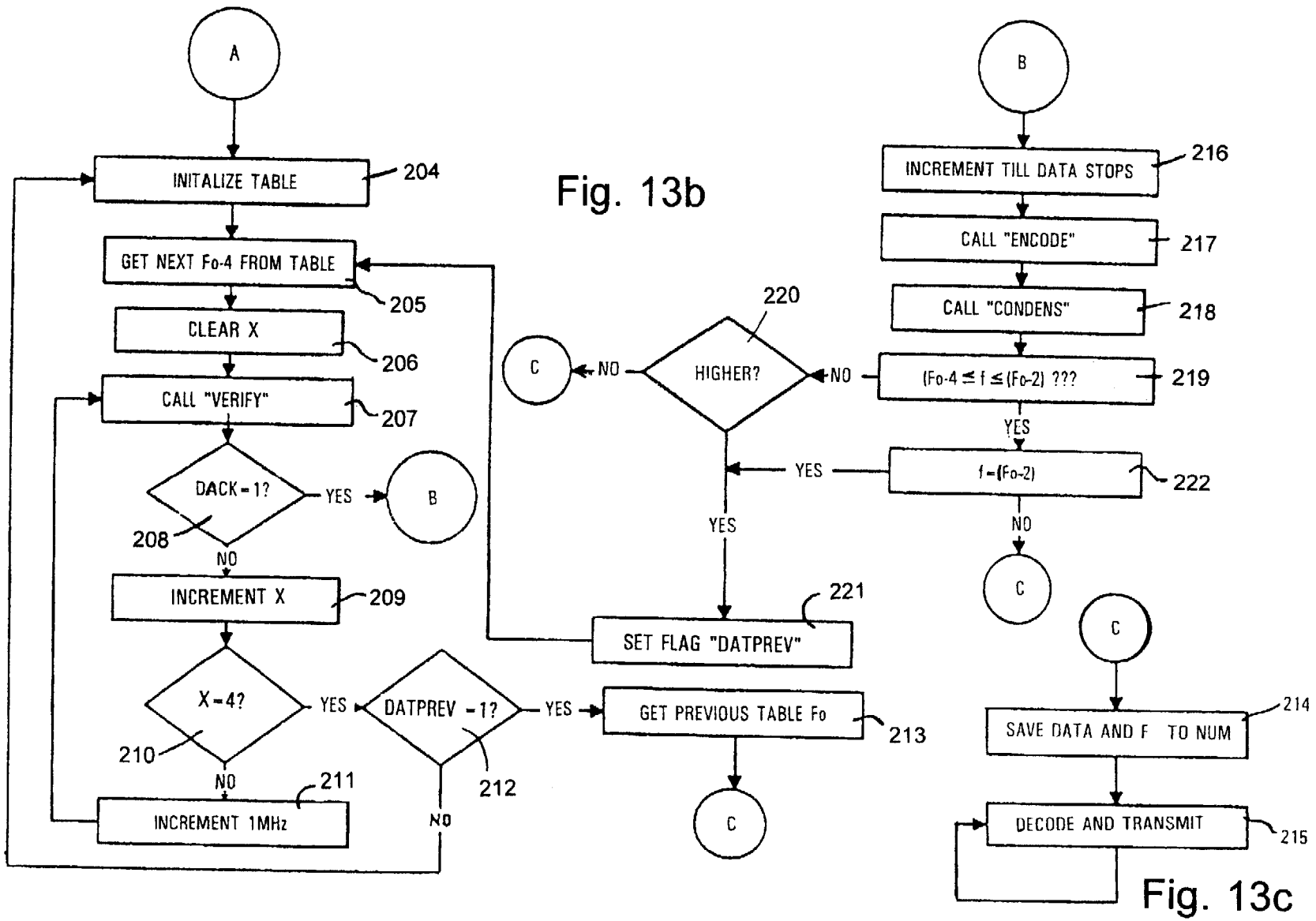

To distinguish between frequencies which are one MHz apart, the micro-controller program determines frequencies at which data is detected. To accomplish this, the frequency output by VCO 365 is increased in one MHz increments until data is no longer detected by the micro-controller as indicated in block 216 (FIG. 13*b*). When the frequency F is incremented such the data is no longer detected, the desired frequency is one MHz less than the highest frequency at which the data was detected.

The micro-controller next calls the "ENCODE" subroutine as indicated in block 217. The ENCODE subroutine is described in greater detail hereinbelow. The micro-controller program digitizes the data input to the micro-controller in the ENCODE subroutine. Following the ENCODE subroutine, the "CONDENSE"0 subroutine is called as indicated in block 218. Because a sequence of data stored in the ENCODE subroutine typically includes more than one data word which is sequentially repeated. The CONDENSE subroutine locates the start and stop points of the repeated word so that the data word is only stored once as described hereinbelow.

After the data is encoded and condensed, the micro-controller program determines the best carrier frequency $F_0$ to emulate signal B. For example, if data is detected when the frequency F of the output signal of VCO 365 is 298 MHz, 299 MHz, and 300 MHz, and data is no longer detected when the frequency F is 301 MHz, the best frequency F to look for data is 299 MHz, and the frequency $F_0$ of the remote control signal B is 302 MHz. In block 219, the micro-controller program determines whether the frequency F output by VCO 365 is greater than or equal to $F_0$-4 MHz or less than or equal to $F_0$-2 MHz. If the carrier frequency F is greater than or equal to $F_0$-4 MHz and less than or equal to $F_0$-2 MHz, the micro-controller program determines whether frequency F is equal to $F_0$-2 MHz as indicated in block 222. If the frequency does not equal $F_0$-2 MHz as determined in block 222, the data detected in the ENCODE subroutine and carrier frequency $F_0$ are stored in the micro-controller non-volatile memory. The micro-controller program then decodes and transmits the stored data signals at frequency $F_0$ as indicated in block 215 (FIG. 13*c*).

If it is determined that the frequency F of the output signal of VCO 365 is not greater than or equal to $F_0$-4 MHz and less than or equal to $F_0$-2 MHz in decision block 219 (FIG. 13*b*), the micro-controller program determines whether the frequency is higher than $F_0$-2 MHz as indicated in decision block 220. If the frequency is less than $F_0$-4 MHz, the micro-controller stores the frequency $F_0$ as indicated in block 214 (FIG. 13*c*) and transmits the frequency and data stored, as indicated in block 215. If it is determined in decision block 220 that the frequency is higher than $F_0$-2 MHz, or if it is determined in block 222 that the frequency equals $F_0$-2 MHz, the micro-controller sets the DATPREV flag to a logic 1, and returns to block 205 to analyze the next frequency in the frequency table. The micro-controller program repeats steps 205–210 until the DACK flag is set or the count in register X equals 4. If the count equals 4, and no data is detected at the current frequency $F_0$, the micro-controller determines whether the DATPREV flag is set in block 212. If the DATPREV flag is set, as determined in block 212, the micro-controller program retrieves the previous table frequency $F_0$ from memory as indicated in block 213. The micro-controller will save the data and the previous frequency $F_0$ in the non-volatile memory as indicated in block 213. The micro-controller will then decode and transmit the stored code and frequency as indicated in block 215.

Figure 14:
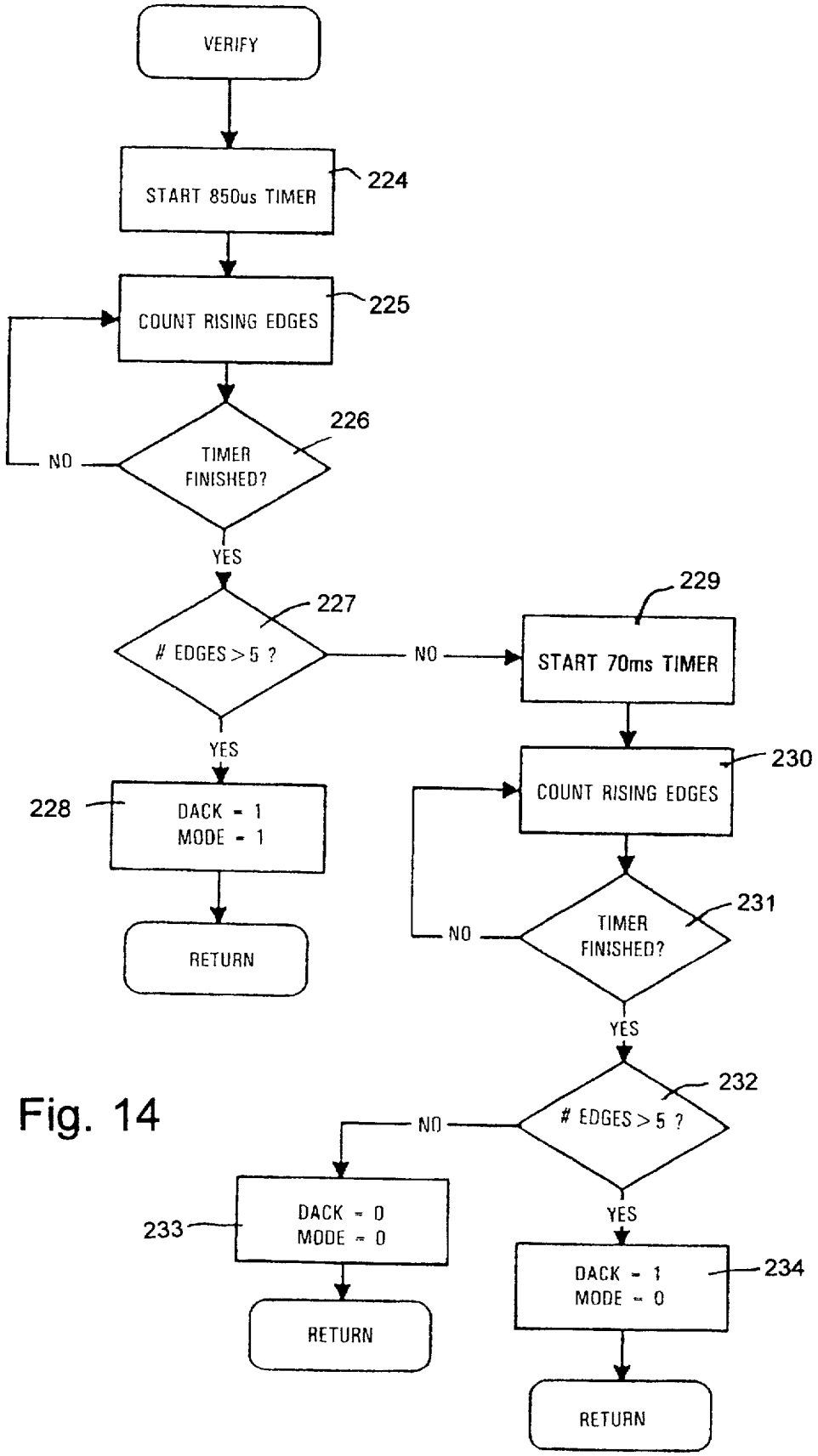
FIG. 14 is a flow diagram for one of the program subroutines shown in FIGS. 13*a*–13*c*.

In the VERIFY subroutine shown in FIG. 14, the micro-controller program determines whether data is being received as indicated briefly above. The micro-controller program first initiates and starts an 850 microsecond timer, as indicated in block 224, and counts rising edges, as indicated in block 225. The micro-controller program continues to count rising edges until the 850 microsecond timer times out, as indicated in decision block 226. When the timer times out, the micro-controller program determines whether the number of edges is greater than five, as indicated in block 227. If more than five edges are detected in the 850 microsecond interval, the DACK flag is set to 1 and the mode is set to 1 as indicated in block 228. In mode 1, the micro-controller has identified amplitude modulated frequency shift key data, such as used by garage door opening systems marketed under the Genie trademark. If five edges were not detected in the 850 microsecond time interval, as determined in decision block 227, a 70 ms timer is started as indicated by block 229. Rising edges are detected and counted during the 70 ms period. When the timer times out, the micro-controller counts the number of edges detected during the 70 ms period. If more than five edges are detected as determined in block 232, the DACK flag is set and the mode is set to 0 as indicated in block 234. Mode 0 indicates that the data format is a binary code associated with a carrier signal. If fewer than five edges are detected in the 70 ms time interval, the DACK flag is set to 0, as indicated in block 233, indicating that data was not acknowledged, and the micro-controller returns to the main program.

Figure 15:
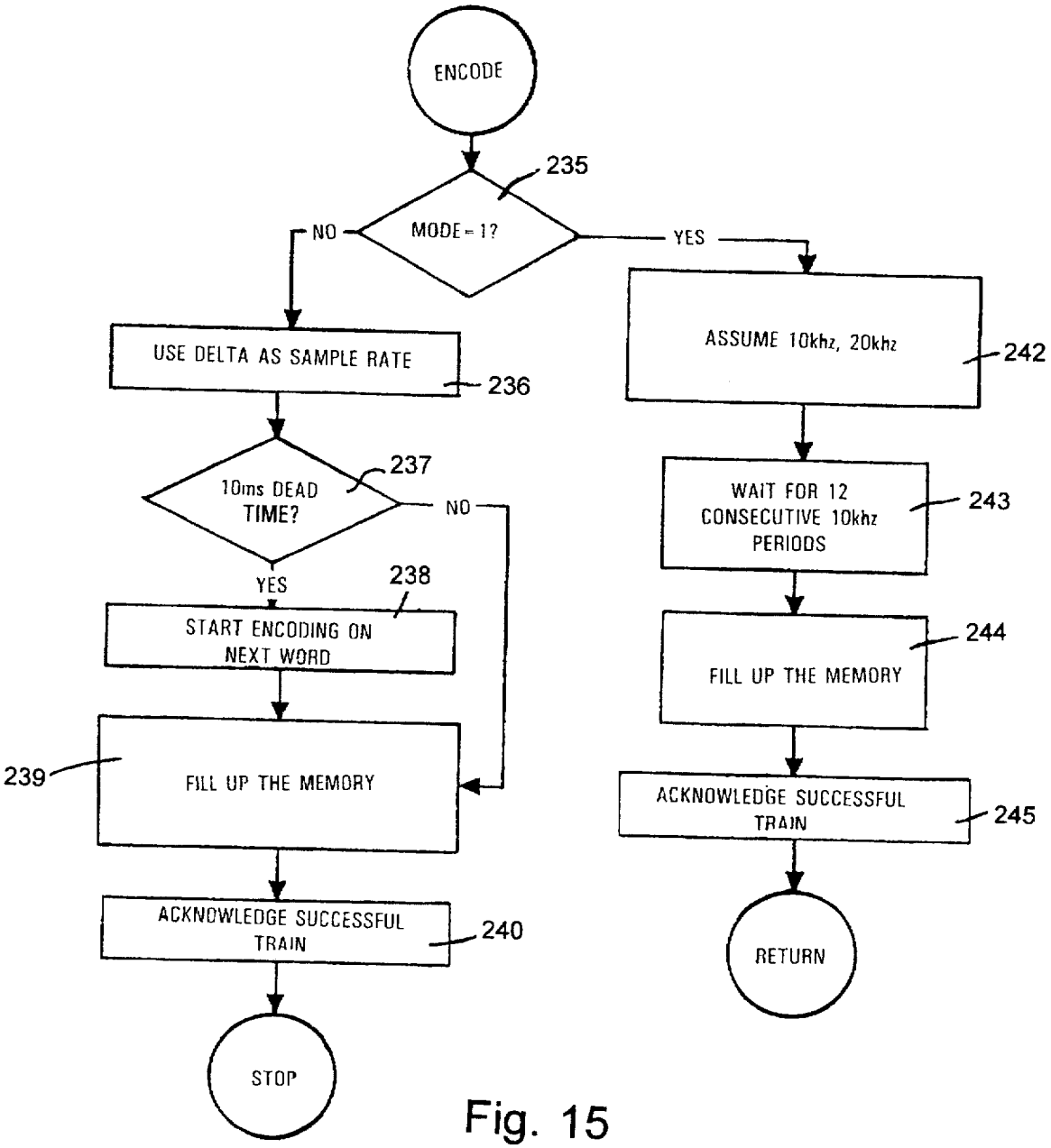
FIG. 15 is a flow diagram for one of the program subroutines shown in FIGS. 13*a*–13*c*.

In the ENCODE subroutine shown in FIG. 15, the micro-controller first determines whether the code is a 0 or a 1 mode, as indicated in decision block 235. If the mode is 0, the micro-controller program samples the input 413 every 68 microseconds as indicated in block 236. The micro-controller program then determines whether a 10 ms dead time has elapsed in decision block 237. If the 10 ms time interval has elapsed, the micro-controller starts encoding on the next detected leading edge. Each 68 microseconds, the micro-controller samples the input. The samples are stored until the memory allocated to the samples is full. If it is determined in block 237 that a 10 ms dead time was not present in the samples, the data is sampled and stored in memory as it is received at input 413. The data samples are stored until the memory is filled as indicated in block 239. After the memory is filled, the micro-controller program acknowledges a successful train by flashing LED 198.

If the micro-controller determines that the code is mode 1 in decision block 235, the micro-controller assumes that the frequency of the signals being received alternate between 10 kHz and 20 kHz frequencies as indicated in block 242. The micro-controller waits for 12 consecutive 10 kHz samples before storing the received code in memory as indicated in block 243. The received code is stored in memory until the allocated memory is filled, as indicated in block 244. The micro-controller then acknowledges the successful train by flashing LED 198 before storing the received code in memory, as indicated in block 243. The received code is stored in memory until the allocated memory for storage of the code is filled, as indicated in block 244.

Figure 16:
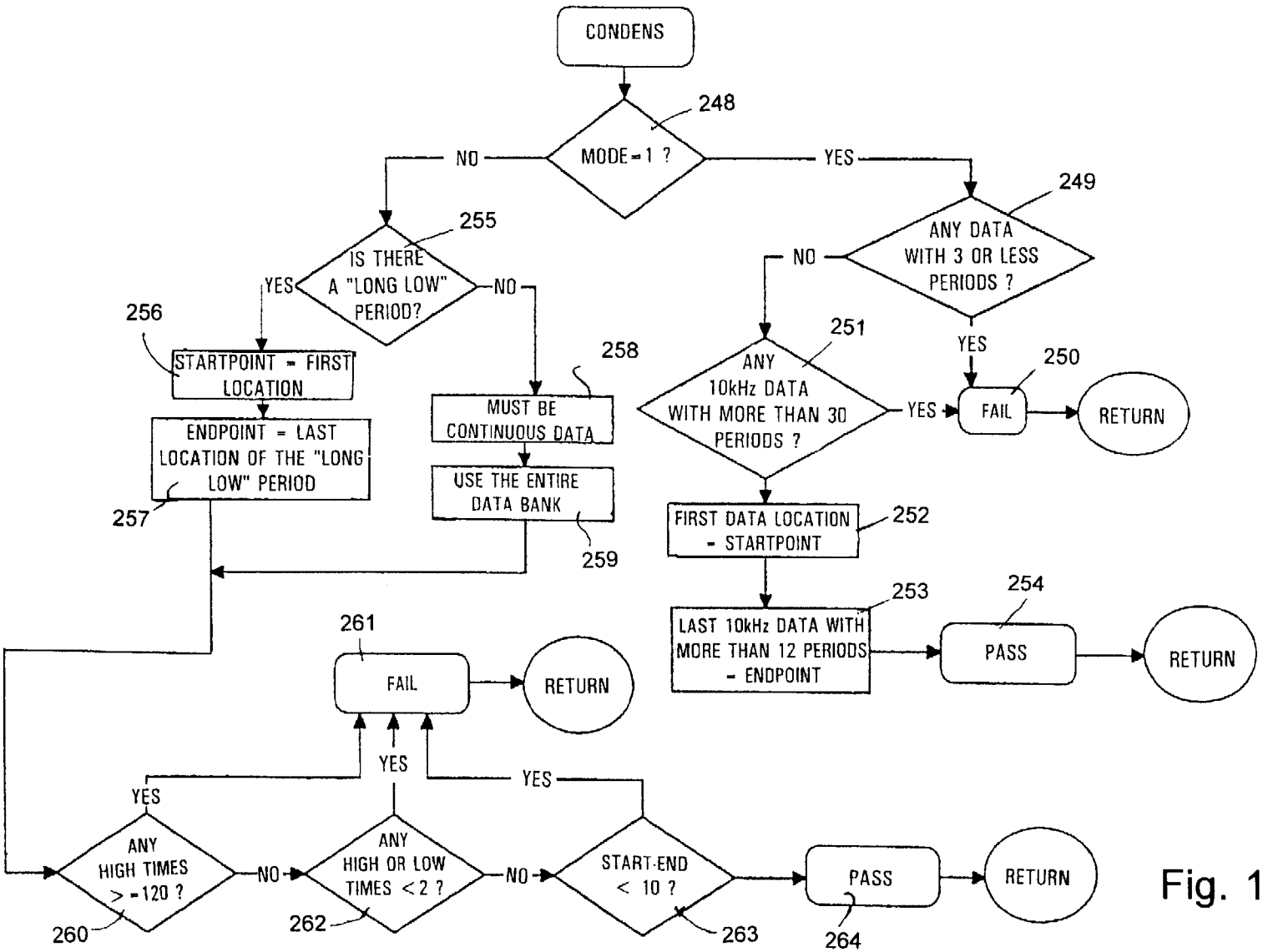
FIG. 16 is a flow diagram for another program subroutine shown in FIGS. 13*a*–13*c*.

In the CONDENSE subroutine shown in FIG. 16, the micro-controller program first determines whether the code is mode 1 or mode 0 code, as indicated in block 248. If the code is mode 1, the micro-controller program determines whether the 10 kHz or 20 kHz signals stored in memory during the ENCODE subroutine have three or fewer periods, as indicated by decision block 249. If one of the frequencies stored in the memory has three or fewer periods, the micro-controller program acknowledges a failure of the training by flashing LED 198 at a rate different from that of the successful train acknowledgment, and the micro-controller returns to the main program.

If the data does not contain three or fewer periods, the micro-controller determines whether the 10 kHz signal has more than thirty periods, as indicated in block 251. If the micro-controller determines that the 10 kHz data has more than thirty periods, the micro-controller program acknowledges a failure as indicated in block 250, and the program returns to the main program. If it is determined that the data does not have more than thirty 10 kHz periods, the data is presumed to be valid. The first data location in the memory is the starting point for the code stored therein. The memory locations are filled until twelve consecutive 10 kHz periods are detected. Thus, the first memory storage location is the beginning of the data word, and the last 10 kHz sequence of twelve consecutive periods is the end point of the word. The micro-controller recognizes a valid train after the sequence of twelve 10 kHz data periods as indicated in block 254.

If it is determined in block 248 that the program is in mode 0, the micro-controller program determines whether there is a long period without a high logic level stored in memory. If there is a long period without a high logic level signal, the starting point of the data word is the first location in the memory, as indicated in block 256. The end point of the data word is the last location in the memory associated with the long low period. The stored data word is thus repeated in the signal "T" transmitted to activate the garage door opening mechanism. If the micro-controller determines that there is no long period without high logic levels in decision block 255, the micro-controller program determines that the data stored in the memory is continuous data as indicated in block 258, and all the data stored in the memory in the ENCODE subroutine is transmitted as indicated in block 259. The micro-controller program determines whether 120 consecutive samples are high logic levels as indicated in block 260. If 120 consecutive samples are high logic level signals, the micro-controller determines that the data stored is contaminated and a failure is signaled using LED 48 as indicated in block 261.

If the micro-controller program passes the test of decision block 260, the micro-controller program determines whether at any location in the data word less than three consecutive samples are at a high or a low logic level, as indicated in decision block 262. This indicates that a noise spike has contaminated the data. If less than three consecutive samples are at single logic level, a failure is detected and the micro-controller program signals a failure using LED 198 as indicated in block 261. If the data passes the test of decision block 262, the micro-controller determines whether the entire data word is stored in less than ten memory locations, as indicated in decision block 263. If the entire word is stored in fewer than ten memory stack locations, the micro-controller identifies a failure as indicated in block 261. If the data passes the test of decision blocks 260, 262 and 263, the micro-controller program identifies a valid training session and returns to the main program.

If one of the GDO activate/train switches 192, 194, or 196 is pushed, the fifteen-second timer is initialized in block 201 (FIG. 13*a*), the panel selector is read and the channel identified by the channel selector is trained, as determined in decision block 203, the micro-controller program downloads frequency $F_0$ and the data word stored in the non-volatile memory associated with the selected channel. The frequency of the divide-by-N counter is set by the signal at outputs 408 of micro-controller 357. Additionally, the attenuation select output 412 is utilized to set the variable attenuator 371 inversely to the duty cycle of the data being transmitted. Thus, if the duty cycle of the control pulses input to switch 370 are long, the amplitude of the signals output through antenna 373 will be proportionally less than the amplitude of signals output from antenna 373 when the pulses have a short duty cycle.

As indicated above, the transceiver includes two training modes for learning two different signal types. In mode 0, an oscillating carrier signal is transmitted when switch 370 is open. The carrier signal is not transmitted when switch 370 is closed. In mode 1, a signal alternating between 10 kHz and 20 kHz signals is continuously transmitting. In mode 1, the number of periods transmitted at each frequency represents the code of the transmitted signal. Because the carrier signal is continuously transmitted in mode 1, the variable attenuator is set to maximum attenuation in mode 1.

Thus, it can be seen that a trainable garage door transmitter is provided which is adapted for use in any remote control garage door opener and includes the flexibility to learn different garage door opener remote control formats. Additionally, the trainable garage door transmitter allows the micro-controller to vary the amplitude of transmitted pulses proportionately to the duty cycle of the transmitted pulses. The trainable transmitter also includes a training technique wherein an input frequency is adjusted until the internal frequency matches an external frequency received by a garage door opener remote control during training. Additionally, the trainable garage door opener has the capability of increasing the number of frequencies identified by control words stored therein. This allows the number of frequency control words to be minimized, reducing the number of frequencies which must be tested to thereby reduce the training time and memory storage requirements of the table, while allowing the number of frequencies to be accommodated. Thus, a flexible and efficient system provides a trainable transmitter in a vehicle which can be integrated into the vehicle as original equipment and replace portable existing transmitters.

It will be recognized that control module 24 including a trainable receiver may be trained to respond to any radio frequency transmitter, such as the remote control sold with garage door opener mechanism 10. The control module may thus be used with a garage door opener mechanism or an appliance control system previously installed in house 26 or garage 27. Additionally, the control module may be trained to respond to one or more remote controls signals associated with the garage door opener control mechanism and appliance control system regardless of the frequency and format transmitted by each such remote controls.

To install the system according to the invention in house 26 (FIG. 2) and garage 27, the homeowner connects control module 24 (FIG. 1) to AC power conductors 28 through wall outlet 30 using connectors 94 and 96. The homeowner than connects terminals 40 and 42 to garage door opener remote control mechanism 10 using conductors 44 and 46. The code selector 106 and house code selector 104 are set to one of their positions. For example, the unit code is set to position 2 and the house code is set to position B such that control module 24 will communicate with other modules set to the same unit code and house code. Additionally, the homeowner may plug a male connector of a lamp into outlet 110 of control module 24.

The lamp receptacle modules 36 (FIGS. 5 and 6) are installed in any lamps which the homeowner wishes to have controlled by the remote control 24. In the illustrated embodiment, a lamp receptacle module is inserted into receptacles in lamps 12 (FIG. 1), 14 (FIG. 2), 16 and 18. The lamp receptacle modules are installed in a lamp by removing a light bulb, screwing the connector 117 of the lamp receptacle module into the lamp's receptacle, and screwing the light bulb into lamp receptacle 116. The homeowner than sets the unit code and house code to the same codes as control module 24 (e.g., unit code 2, house code B). The switches of lamps having lamp receptacle modules 36 therein are set to their "on" position.

The homeowner may also install one or more outlet modules 123 (FIG. 7) into various AC power outlets in house 26. Male connectors from associated lamps are connected to outlet 130 in the outlet modules. The unit selector 131 and house code selector 132 are set to the same position as control module 24 (e.g. unit code 2, house code B). The switches of lamps connected to outlet modules 123 are placed in their "on" position.

The training of the control module will be described below. However, it is initially noted that if switch 108 (FIGS. 4, 9 and 10) is pressed momentarily (e.g., 1 second or less, such that it is released when the indicator begins flashing) the control module enters a training mode. If switch 108 is closed for a longer time period (e.g., at least 3 seconds) switch 172 changes state. Thus, if switch 172 is closed, it will open when switch 108 is held for the longer time period. If switch 172 is open, the control module will close switch 172 when switch 108 is held for this longer time period. Accordingly, switch 108 is both a training switch and a manual on/off control switch for outlet 110.

In the training mode control module 24, 135 (FIGS. 4 and 9) may be trained to at least three different codes as described herein. The homeowner uses selector 138 to select either lights on and garage door opener mechanism operation, lights off and garage door opener mechanism operation, garage door opener only operation, or lights on/off only operation. Additionally, the homeowner user selector 111 to turn the timer off, set the time for the short time period, or set the timer for the long time period. The homeowner than places the transmitter 22 in close proximity to control module 24 and closes switch 108. Indicator 112 flashes upon actuation of button 108. Upon actuation of switch 192 (FIG. 3), microcontroller 143 (FIG. 9) learns the signal transmitted by transmitter 22 and associates the operation selected using switches 138 and 111 with that control signal. When the control signal is learned, indicator 112 stops flashing. The microcontroller then stores the learned signal and its associated operation, and the control module returns to an operating mode.

The training sequence may be repeated for each of the signals emitted by transmitter 22 (FIG. 3) using selector 138 (FIG. 9), switch 108, and switches 194 and 196. Additionally, although transmitter 22 is illustrated as a three signal transmitter, it will be appreciated that a plurality of radio frequency remote control signals may be learned by the control module. For example, a homeowner may have a Genie brand garage opener mechanism or a Craftsman brand garage opener mechanism. Control module 24 learns both of these signals and may store respective, associated, operations with each signal.

Figure 10:
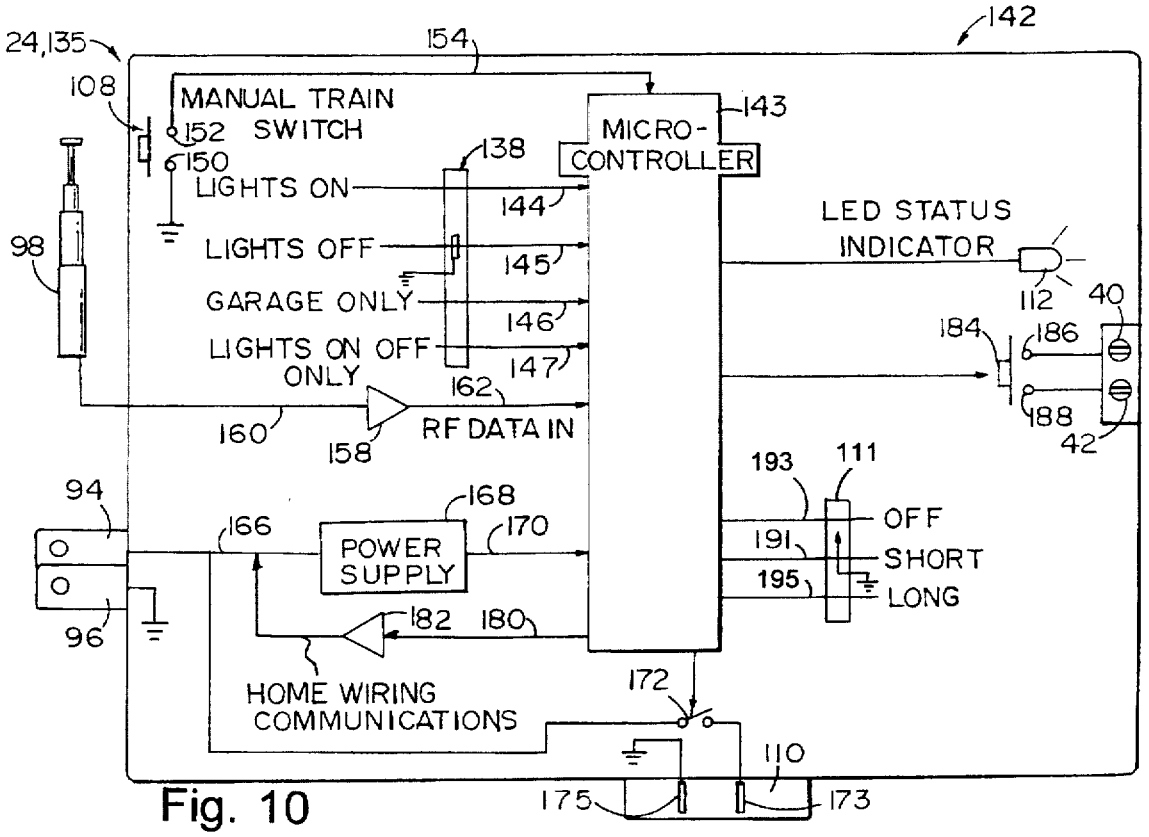
FIG. 10 is a circuit schematic in block diagram form of the circuit for the control module according to FIGS. 4, 8 and 9.

Upon receipt of a control signal in an operating mode, the control module compares the received control signal to control signals already stored in microcontroller 143 (FIG. 10). If the control module has been trained for the received control signal, the microcontroller will perform the associated operation stored with that control signal. For example, a control signal may have a "lights on" operation associated therewith. When that control signal is received from a remote control, the control module will output a signal over the AC power line telling all modules having the same unit and house code to connect their outlet contacts to their respective power connectors. Another received control signal may have garage door opener operation associated therewith. Upon receipt of that control signal, control module 24 closes switch 184 to output a control signal to terminals 40 and 42 which effects actuation of the garage door opening mechanism.

It will be recognized that the radio frequency receiver in microcontroller 143 may be provided by any suitable radio frequency receiver, and that the control unit may be dedicated to a single frequency and signaling format. By way of example, a transmitter 22 may include three switches for transmitting three respective control signals, each control signal having the same carrier frequency and a different control code. A different operation may be associated with each signal in a training mode. The Control module may then be used to provide different operations responsive to actuation of different switches on the transmitter.

According to an alternate embodiment of the invention, the timer position is not stored with the control signal operation. The timer operation is determined each time a garage door opener plus lights on control signal is received. Accordingly, if timer selector 111 is set to the off position when such a control signal is received, the microcontroller will not automatically transmit a control signal to turn off the lights a predetermined time period after the lights are turned on. If the timer selector 111 is set to the short position when a garage door opener plus, lights on control signal is received, the microcontroller will transmit a control signal to turn the lights off when the predetermined short time period has expired. If timer selector 111 is in the long position when a garage door opener plus lights on control signal is received, the microcontroller will transmit a control signal to turn the lights off after the predetermined longer time period has expired.

Accordingly, it can be seen that a system for remotely controlling a garage door opener mechanism and household appliances such as lamps is disclosed which provides ease of installation and a flexibility in application. The system is readily retrofit for use with installed garage door opener mechanisms and provides versatility in operation. According to one aspect of the invention, the control module may be trained to respond to any radio frequency remote control, which reduces the number of remote controls which must be purchased and stored to control the garage door opener and household appliances.

It will be recognized by those skilled in the art that these and various other modifications to the preferred embodiments of the invention as described herein can be made without departing from the spirit and scope of the invention as defined by the appended claims.

The embodiments of the invention in which an exclusive property or privilege is claimed are defined as follows:

1. A system for selectively controlling the operation of at least one lamp and at least one garage door opener, comprising:

a control module including a housing;

contacts positioned on said housing, said contacts adapted to be connected to at least one lamp through residential AC power conductors;

terminals positioned on said housing, said terminals adapted to be connected to conductors coupled to at least one garage door opener mechanism;

a selector switch positioned on said housing for selecting garage door or light control operations; and circuit means positioned in said housing, said circuit means including a train switch movable between training and operating positions for controlling said circuit means between training and operating modes of operation, said circuit means responsive in said training mode of operation to the receipt of a radio frequency control signal of unknown frequency in the range of 200 to 400 MHz for receiving and learning the frequency and signal format of said received signal, said circuit means coupled to said selector switch for storing operations to be associated with each of said control signals in said training mode, and said circuit means adapted to output control signals to said contacts for communication over the AC power conductors for controlling lamps, and to said terminals for controlling operation of the garage door mechanism, whereby said circuit means outputs control signals to said terminals and said contacts in accordance with stored associated operations upon receipt of learned control signals when each of said learned control signals is received when said train switch is in said operating position.

2. The system as defined in claim 1, wherein said circuit means is adapted to learn a plurality of different frequency control signals, each having a different carrier frequency and signaling format.

3. The system as defined in claim 1, further including at least one lamp receptacle module adapted to be inserted into a lamp receptacle and receive a light bulb, said lamp receptacle module adapted to communicate with said control module through the AC power conductors.

4. The system as defined in claim 1, further including at least one outlet module adapted to be coupled to AC power outlets, said outlet module adapted to communicate with said control module through said AC power conductors.

5. The system as defined in claim 4, wherein said circuit means is adapted to be programmed to actuate the garage door opener mechanism and the lights responsive to a first control signal, to control only the garage door opener in response to a second control signal, and to control only the lights in response to third control signal.

6. The system as defined in claim 1, further including a timer selector switch coupled to said circuit means, said circuit means responsive to said timer selector switch for selecting a time delay before a lights off control signal is transmitted following transmission of a lights on control signal.

7. The system as defined in claim 6, wherein said timer selector switch has a first timer off position, a second short time position, and a third longer time position, said circuit means automatically outputting a lights off signal a first predetermined time period after emitting a lights on signal when said timer selector switch is in said second position, said circuit means automatically outputting a lights off signal a second predetermined time period after emitting a lights off signal when said timer selector switch is in said third position.

8. A system for controlling at least one outlet module coupled to household AC power conductors responsive to a control signal from a remote control, comprising:

a control module housing;

contacts positioned in said housing and adapted to be plugged into an AC power outlet;

a sensor for receiving a control signal from a radio frequency remote control; and a circuit including a train switch movable between training and operating positions, said circuit responsive when said train switch is in said training position for learning and storing the frequency and signal format of a control signal received from a remote control, said frequency of said control signal being within the range of 200 to 400 MHz and storing a module control signal to be associated with the received control signal in a training mode, said circuit coupled to said contacts for selectively controlling the outlet module according to the operations stored for said stored signal when said stored signal is received from a remote when said train switch is in an operating position.

9. The system as defined in claim 8, further including at least one lamp receptacle module adapted to be inserted into a lamp receptacle to receive a lamp, said lamp receptacle module adapted to communicate with said control module through the AC power conductors.

10. The system as defined in claim 8, further including at least one remote module adapted to be coupled to AC power outlets and adapted to communicate with said control module through the AC power conductors.

11. The system as defined in claim 8, wherein said circuit includes a second switch used to select whether a lights off signal will be transmitted automatically by said control module following transmission of a lights on control signal.

12. The system as defined in claim 11, wherein said second switch is also used to select the time delay between transmission of a lights on signal and a lights off signal.

13. A system for controlling operation of a garage door opener and household lamps, comprising:

a control module including a receiver for detecting control signals from remote controls, said receiver adapted to learn the frequency and signaling format of a plurality of control signals and associate a respective operation with each learned control signal, said control module adapted to be coupled to AC power conductors, wherein the frequency of the control signal is within the range of 200 to 400 MHz;

a garage door opener mechanism adapted to be coupled to said control module and for moving a garage door in response to at least one control signal;

a remote module for connection to AC power conductors for receiving a control signal from the control module through the AC power conductors; and wherein when said control module is connected to AC power conductors, the garage door opener mechanism is connected to said control module, the remote modules are connected to AC power conductors, and the control module is trained to each one of a plurality of control signals, the control module is responsive to radio frequency control signals from remote controls to selectively control the remote modules and the garage door opener mechanism according to the respective associated operation stored for each received control signal.

14. The system as defined in claim 12, wherein said control module further includes a selector for selecting one of a plurality of operations, said selector used to uniquely program said control module for each one of said control signals in a training mode.

15. The system as defined in claim 13, wherein said selector selects garage door opener or remote control operation for each signal received from a remote control.

16. The system as defined in claim 15, wherein said control module is adapted to be programmed to actuate the garage door opener mechanism and the remote modules responsive to a first control signal, to control only the garage door opener in response to a second control signal, and to only control the remote modules in response to a third control signal.

17. The system as defined in claim 13, wherein said control module includes a timer selector, said control module selectively transmits a lights on control signal to remote modules when the garage door opener mechanism is actuated, and the control module responsive to said timer selector to selectively transmit a lights off control signal a predetermined time period after the lights on control signal is transmitted to the remote module.

18. The system as defined in claim 8 and further including:

terminals disposed on said housing and adapted to be coupled to a garage door opening mechanism, wherein said circuit is coupled to said terminals for selectively actuating the garage door opener mechanism and controlling the lights according to the operations stored for each of said stored signals when each of said stored signals is received from a remote control when said train switch is in an operating position.

19. The system as defined in claim 18, wherein said circuit is adapted to be programmed to actuate the garage door opener mechanism and the lights responsive to a first control signal, to control only the garage door opener in response to a second control signal, and to control only the lights in response to third control signal.

* * * * *